US012691369B2

(12) United States Patent
Turner

(10) Patent No.: US 12,691,369 B2
(45) Date of Patent: Jul. 28, 2026

(54) THUMB WRESTLING GAME BOARD

(71) Applicant: Seth Turner, Stone Ridge, NY (US)

(72) Inventor: Seth Turner, Stone Ridge, NY (US)

( * ) Notice: Subject to any disclaimer, the term of this patent is extended or adjusted under 35 U.S.C. 154(b) by 201 days.

(21) Appl. No.: 18/812,617

(22) Filed: Aug. 22, 2024

(65) Prior Publication Data

US 2026/0054160 A1 Feb. 26, 2026

(51) Int. Cl.
*A63F 9/00* (2006.01)

(52) U.S. Cl.
CPC ..... *A63F 9/00* (2013.01)

(58) Field of Classification Search
CPC ..... A63F 9/00; A63F 2009/247; A63H 13/06; A63B 21/28; A63B 21/285
USPC ..... 273/452–455; 482/905, 906
See application file for complete search history.

(56) References Cited

U.S. PATENT DOCUMENTS 3,790,165 A * 2/1974 Schmidt ..... A63H 13/06 273/452
4,176,837 A * 12/1979 Jeffrey ..... G07F 17/36 482/905
4,327,910 A * 5/1982 Mackie ..... A63B 21/28 273/452
4,557,481 A * 12/1985 McClure ..... A63B 71/0605 482/905
4,998,724 A * 3/1991 Hartman ..... A63H 13/06 273/452

FOREIGN PATENT DOCUMENTS

GB 2507461 A 5/2014
JP 3051745 U 9/1998

OTHER PUBLICATIONS

Thumb Thing Electronic Thumb Wrestling Game Handheld Toy Tiger 2003 Hasbro, found: Mar. 25, 2024, https://www.ebay.com/itm/276312185290?itmmeta=01HSTSXC1KE . . . 7 pages.
Thumb Wrestling War, found Mar. 25, 2024, https://poshmark.com/listing/Thumb-wrestling-game-646a743d382db8 . . . 2 pages.
Hog Wild Toys—Pro Thumb Wrestling Arena—The Original Thumb Wrestling Sensation—Declare The Thumb War Champion, found: Mar. 24, 2024, https://www.amazon.com/Hog-Wild-Thumb-Wrestler-Colors/dp/B000 . . . , 5 pages.

* cited by examiner

*Primary Examiner* — Thomas M Sember
(74) *Attorney, Agent, or Firm* — Saile Ackerman LLC; Stephen B Ackerman

(57) ABSTRACT

A thumb wrestling game board is disclosed, instituting pin-or-pop technology and rules that prevents participants from aggressively pulling and jerking their opponents. A stem at the center of a reaction device is designed for players to grasp while they compete. If a player accidentally pulls their wrist lanyard and it dislodges an attached pin, an elastic band with a ring activates the reaction device. The ringing of a bell, flashing of a light, or vibration indicates the player has lost through the "pop method" of the game.

15 Claims, 2 Drawing Sheets

THUMB WRESTLING GAME BOARD

BACKGROUND

Field

The present disclosure relates generally to a game board used for competitive thumb wrestling.

Background

"Thumb wrestling" is a traditional game played between 2 people who are facing one another. The two players interlock one hand each, with their thumbs facing upward. The primary object of the game is for one player to "pin" (hold down for some time period) their opponent's thumb with their own thumb, also known as a pinfall (one person uses a thumb to hold down their opponent's thumb for several seconds) which counts as a win. These contests are held with two opponents grasping the fingers of a corresponding hand as they thumb wrestle and attempt to pin the other's thumb. Often, stronger and/or more aggressive participants pull and twist their opponents during the contest. This pulling and twisting of arms and wrists make the competition less about the strength and dexterity of players' thumbs.

SUMMARY

The present disclosure seeks to provide a thumb wrestling game board using "pin-or-pop" technology and rules, to make certain that a thumb wrestling contest is held on the game board, and that the best thumb wrestler wins the competition.

Accordingly, it is an object of one or more embodiments of the present disclosure to provide a wrist lanyard attached to a pin that must be kept in place during a thumb wrestling competition.

It is a further object of the disclosure to provide an audible, visual, and/or tactile reaction as a result of a person pulling the wrist lanyard away from the thumb wrestling game board.

The above and other objects of the present disclosure may be accomplished in the following manner. A thumb wrestling game board is disclosed, including a game base, a reaction device affixed to the game base, and a stem attached to the reaction device. Two game pins are attached at opposing sides of the game base. Each of the game pins comprises a wrist lanyard attached to a pin, and an elastic band with a ring, wherein during play each elastic band is held in stretched tension by the game pins and wherein the removal of the pin causes an audible, visual, and/or tactile reaction.

The objects of the disclosure are further achieved by providing an indicator of a pulled pin with an alarm bell, flashing light, or vibrating device.

The object of this disclosure includes its variants, and its alternative embodiments, independently of its applications or processes it may be applied to.

BRIEF DESCRIPTION OF THE DRAWINGS

The present disclosure will be more clearly understood from the following description taken in conjunction with the accompanying drawings in which like reference numerals designate similar or corresponding elements, regions, and portions and in which.

DETAILED DESCRIPTION

The present disclosure discloses a game board used for competitive thumb wrestling matches, using a pin-or-pop mechanism, and can be played with rules that discourage participants from aggressively pulling and jerking their opponents. A stem at the center of a reaction device is designed for players to grasp while they compete. If a player accidentally pulls their wrist lanyard and it dislodges an attached metal pin, an elastic band with a ring strikes the reactive device. The use of the wrist lanyard attached to each player's wrist encourages fair play, i.e. an emphasis of thumb strength and dexterity, since any unfair pulling or twisting of a player's own arm will cause a pin to dislodge and ring a bell or other reactive device. An audible, visual, and/or tactile reaction indicates the player has lost through the "pop method" of the game.

Figure 1:
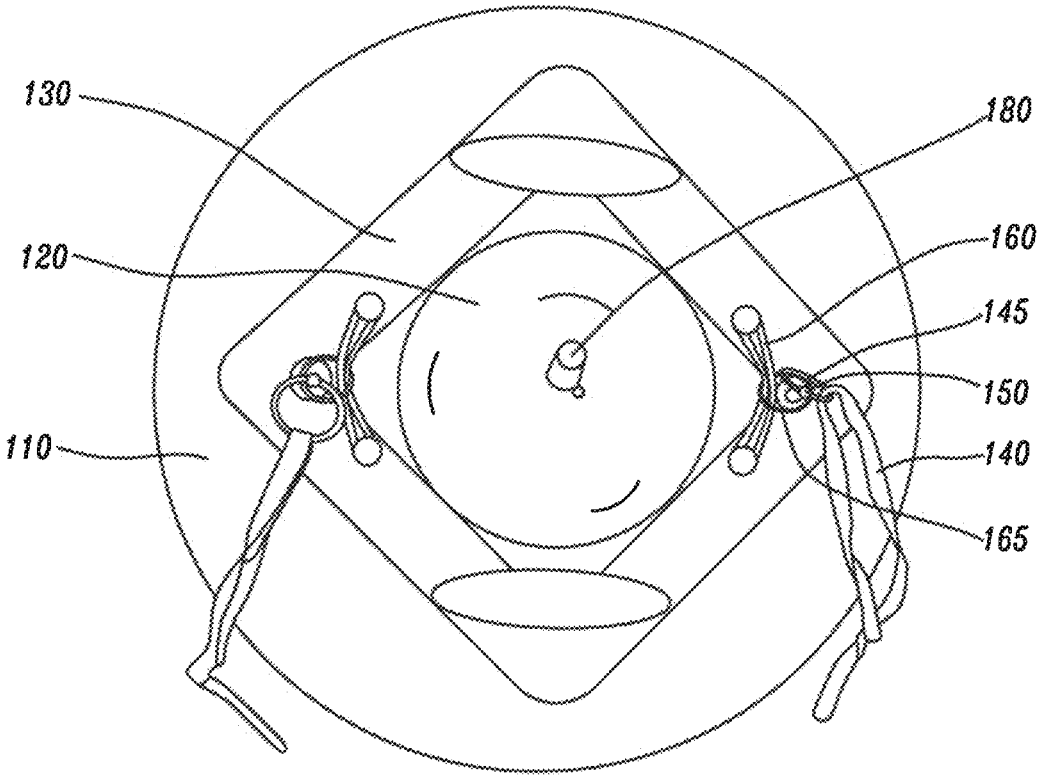
FIG. 1 shows a top perspective of a circular thumb wrestling game board, with a square frame and an alarm bell, in a first embodiment of the present disclosure.

FIG. 1 shows a top perspective of a circular game board, with a square frame and a reaction device, in a first embodiment of the present disclosure. What can be seen from this view is the circular game board 110, alarm bell 120, square frame 130, and each of two mechanisms for thumb wrestling participants during competition. Each of the mechanisms comprise wrist-lanyard 140, metal clip 145, metal pin 150, elastic band 160, and metal ring 165. Elastic band 160 is held in tension by metal ring 165 around the outer side (relative to game board center) of the metal pin.

The wrist-lanyard 140 may be worn by each competitor. The lanyards may have metal clip 145 affixed to metal safety release pin 150. The safety release pin is inserted through metal ring 165, which encircles elastic bands 160, creating tension as the pin is further inserted into the game board and secured. Only if/when a competitor pulls the lanyard will the pin be released, which then frees the metal ring to strike the bell. Additionally, an 8 clip, or any other small metal object may be used in place of the metal ring, if it creates the desired audible effect. A manufactured steel object with a logo or image(s) may also be used as the metal ring.

The game board may be comprised of a circular game board 110, for example, made of wood and diameter of about 15" in width and ¾-1" in height. The game board may further comprise an alarm bell 120, for example, 6" wide and affixed to the center of the circular game board. The bell may be surrounded by a square frame 130, for example, made of wood or acrylic or plastic, and about 6.5" in length, 0.75" in height, and 1.5" in width. The square frame includes two mechanisms attached at opposing corners to ring the bell if a player pulls away from the game board during competition. Each of the mechanisms comprise a wrist-lanyard 140, for example, 6" in length and 12" around, attached via, for example, a ¾" metal clip 145 to, for example, a 2" long and ¼" diameter metal pin 150. The metal pin 150 holds in place elongated elastic band 160, with, for example, a ¾" metal ring 165. At the center of the bell is a metal stem 180, for example, 3" in height and a 5/16" in width, and covered with preferably wood, plastic, or metal washers/cut circles, or grip tape for grasping during competition.

Figure 2:
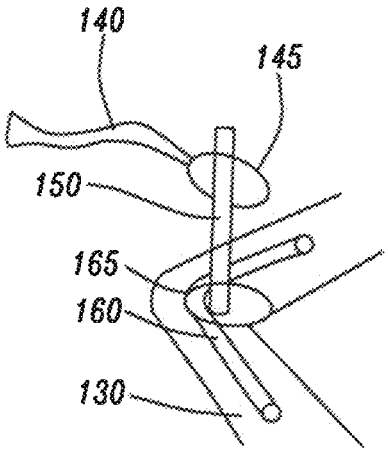
FIG. 2 shows a detailed view of a wrist lanyard attached to a metal pin and an elastic band with a ring, in the first embodiment of the present disclosure.

FIG. 2 shows a detailed view of the attached metal pin and elastic band with ring, in the first embodiment of the present disclosure. If a thumb wrestling participant accidentally pulls their wrist lanyard 140, and it dislodges attached metal pin 150 from wooden frame 130, metal ring 165, encircling elastic band 160, strikes the alarm bell stopping the competition.

Figure 3:
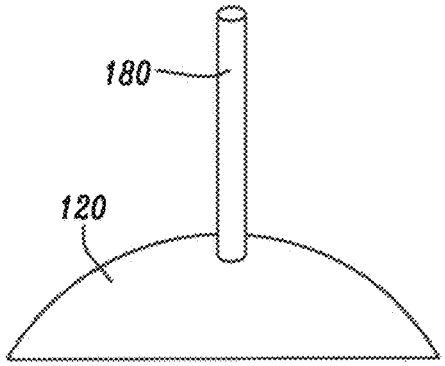
FIG. 3 shows a detailed view of the alarm bell, with a metal stem covered with wood, plastic, or metal circles/washers, or grip tape.

FIG. 3 shows a detailed view of the alarm bell, with a stem, in the first embodiment of the present disclosure. Here, metal stem 180 is attached to the center of alarm bell 120, and may be covered with wood, plastic, and metal circles/washers. Alternatively, grip tape may cover the stem.

The metal stem's handle is created with wood, plastic, and metal circles/washers and held in place by a nut. A tension washer is used, and the stem is screwed into the base of the bell, which has already been attached to the game board.

The bell has a solid base that attaches to the wooden circle with, for example, four 1" screws. The base of the bell may be, for example, a 4" square that comes with the alarm bell. The base may be metal or plastic, and at its center is a preset hole for the stem to screw in place, and securely hold the bell. This may be the same preset hole that was designed to hold the bell onto the base.

Figure 4A:
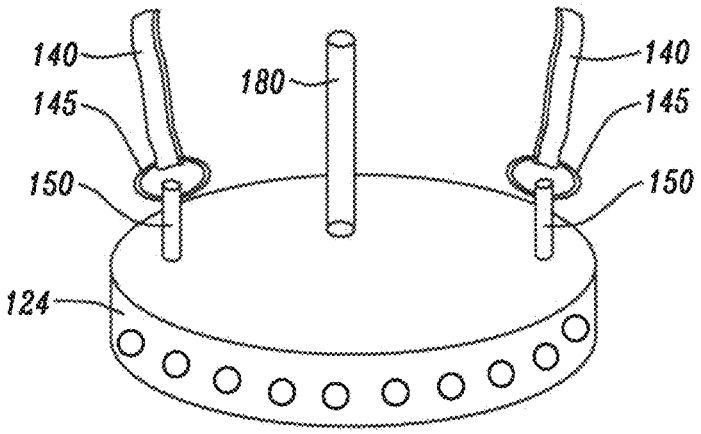
FIGS. 4A and 4B show a second and third embodiment, including a flashing light or a vibrating device to indicate a "pop".
Figure 4B:
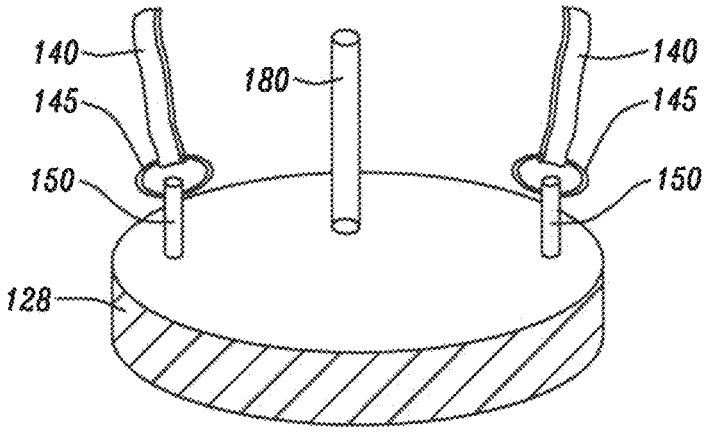

FIGS. 4A and 4B show a second and third embodiment including a flashing light and vibrating device to indicate a "pop", when a player accidentally pulls their wrist lanyard, and it dislodges the attached metal pin. FIG. 4A illustrates, for example, LED type lights 124 along the base of the game. FIG. 4B illustrates a vibrating mechanism 128, where, for example, the mechanism is inside of the base (not visible). The center pin 180 and wrist-lanyards 140 attached to the safety release pin 150 remain key parts of the game board in all versions. The design of the game does not require the function of an elastic band, or any object to physically move to indicate that a pin has been pulled. A wrist lanyard which is attached to a device that triggers a circuit such as a light or a vibrating device may also be used to indicate that a competitor was too aggressive during thumb wrestling. In this case, instead of a bell being rung, a light or a vibrating mechanism indicates to competitors if a pin has been pulled during a contest.

The key concepts of using a center stem to thumb wrestle, along with attached wrist lanyards affixed to a trigger device that can set off an alarm, can be easily transitioned from a bell to another type of model. As long as there is a stem at the center of the thumb wrestling game board, the wrist lanyards can be attached to a device that sets off any type of alarm. The design of such games could use similar and established measurements of the original game board, where the use of a bell can be supplanted with other methods of alarm such as a light, or vibration, etc.

An exemplary model of the thumb wrestling game board includes, for example, a wooden circle 15" in width and ¾"-1" in height, and a wooden/acrylic square 6.5" in length, 0.75" in height, and 1.5" in width attached to the wooden circle. The square may be comprised of, for example, ½" basswood with ⅛" acrylic or, for example, ¾" plywood. An alarm bell may be attached to a base, where the base is screwed into the wooden circle. The bell, wooden/acrylic square, and wooden circle are all aligned and centered. On opposing sides of the game board, there are predrilled holes, for example, ¼" in diameter, designed for the, for example, 1½" safety release pins affixed to the wrist lanyards. A metal washer may be in place to protect for wear/tear around the drilled hole designed for the safety release pin. On each side of the game board, 2 knurled thumb nuts, for example, 12 mm×8 mm, are secured to the wooden/acrylic square with, for example, 1¼" screws. Four total knurled thumb nuts may be used for the game board. The thumb nuts hold in place the elastic bands, encircled with, for example, a ¾" metal ring. The ¾" metal ring is pulled back and held in place by the safety release pins. A 3" metal stem with handle is then inserted into the bell's center, where the original nut has been removed before attaching the base to the wooden circle. Both the bell and stem are attached to the base.

Some of the materials used in the construction of the thumb wrestling game board include a wooden circle, basswood or plywood, hardware, elastic bands, acrylic, knurled thumb nuts, metal, alarm bell, wrist lanyards, and safety release pins. The base may also be plastic or acrylic, and the center pin may be designed with molds and the use of rubber or silicone, although metal is an option too. The safety release pins may be replaced by more fashionable designs, and may include metal, plastic, or acrylic materials. The use of a square and circle is consistent with any design of the thumb wrestling game board.

The main advantage of one or more embodiments of the present disclosure includes providing a novel method for thumb wrestling. The center stem is designed for contestants to grasp, and the solid base is meant to keep the competition in place, on a table or countertop. The removal of a pin causes an audible, visual, and/or tactile reaction, if a competitor pulls or twists too hard while thumb wrestling, adding a new method of making the game fair and fun. During play and after, if the pin is removed due to twisting/pulling of a player's arm, the game can be easily reset by re-installing the pin into the game board and re-tensioning the elastic band around the base of the pin.

While particular embodiments of the present disclosure have been illustrated and described, it will be understood by those skilled in the art that various changes in form and details may be made without departing from the spirit and scope of the invention.

What is claimed is:

1. A thumb wrestling game board comprising:
a game base;
a reaction device affixed to the game base;
a stem attached to the reaction device; and
two game pins attached at opposing sides of the game base,
wherein each of the game pins comprises a wrist lanyard attached to a pin,
and an elastic band with a ring, wherein during play the each elastic band is held in stretched tension by said game pins; and
wherein the removal of the pin causes an audible, visual, and/or tactile reaction.

2. The thumb wrestling game board of claim 1, wherein the stem is covered with wood, plastic, metal washers/cut circles, or grip tape.

3. The thumb wrestling game board of claim 1, wherein the reaction device comprises an alarm bell, a flashing light or a vibrating device.

4. The thumb wrestling game board of claim 1, wherein the stem is attached to the reaction device by a nut and tension washer.

5. The thumb wrestling game board of claim 1, wherein the stem is attached to the center of the reaction device.

6. The thumb wrestling game board of claim 1, wherein the reaction device is attached to the game base by screws.

7. The thumb wrestling game board of claim 1, wherein the reaction device is attached to the center of the game base.

8. The thumb wrestling game board of claim 1, wherein the game board materials comprise metals, plastics, or acrylics.

9. The thumb wrestling game board of claim 1, wherein the game base is wooden, and is 15" in diameter and 1" in height.

10. The thumb wrestling game board of claim 1, wherein the game base is circular.

11. The thumb wrestling game board of claim 1, wherein the reaction device is 6" in diameter.

12. The thumb wrestling game board of claim 1, wherein the stem may be designed with molds and is 5/16" in diameter and 3" in height.

13. The thumb wrestling game board of claim 1, further comprising a square frame surrounding the reaction device.

14. The thumb wrestling game board of claim 13, wherein the square frame is wooden, and has a length of 6.5", a height of 0.75", and a depth of 1.5".

15. The thumb wrestling game board of claim 1, wherein the ring is metal, or is a manufactured steel object with a logo or image.

* * * * *